United States Patent [19]

Holvoet et al.

[11] Patent Number: 4,546,027

[45] Date of Patent: Oct. 8, 1985

[54] NON-WOVEN MATERIAL FOR MEDICAL COMPRESSES

[75] Inventors: Marcel Holvoet, Louviers; Bernard Picard, Amfreville la Campagne, both of France

[73] Assignee: Beghin-Say S.A., Thumeries, France

[21] Appl. No.: 545,383

[22] PCT Filed: Dec. 16, 1982

[86] PCT No.: PCT/FR82/00211

§ 371 Date: Sep. 28, 1983

§ 102(e) Date: Sep. 28, 1983

[87] PCT Pub. No.: WO83/02630

PCT Pub. Date: Aug. 4, 1983

[30] Foreign Application Priority Data

Jan. 29, 1982 [FR] France ..... 82 01392

[51] Int. Cl.[4] ..... A61F 13/00; A61F 15/01; D04H 5/06; D04H 5/08

[52] U.S. Cl. ..... 428/109; 428/182; 428/183; 428/219; 428/339; 428/340; 604/384; 604/385 R

[58] Field of Search ..... 604/385, 384; 428/109, 428/182, 183, 219, 339, 340

[56] References Cited

U.S. PATENT DOCUMENTS

| | | | |
|---|---|---|---|
| 728,828 | 5/1903 | Arlsell | 428/183 |
| 2,758,047 | 8/1956 | Dowd | 428/183 |
| 3,130,412 | 4/1964 | Fox et al. | 428/183 |
| 3,494,362 | 2/1970 | Burgeni | 428/182 |
| 3,837,338 | 9/1974 | Chesky et al. | 428/182 |
| 4,001,472 | 1/1977 | Thomas et al. | 428/182 |
| 4,211,807 | 7/1980 | Yazawa et al. | 428/109 |
| 4,333,979 | 6/1982 | Sciaraffa et al. | 428/183 |

FOREIGN PATENT DOCUMENTS 2418829 9/1979 France .

*Primary Examiner*—James C. Cannon
*Attorney, Agent, or Firm*—A. W. Breiner

[57] ABSTRACT

Curled non-woven material formed of waves such as contiguous anti-nodes (9,10) of adjacent waves consist of small adjacent pads (11,12) located on the same side of the median plan (8) of the non-woven material.

Use: Medical and surgical compresses

FIG. 3.

12 Claims, 4 Drawing Figures

NON-WOVEN MATERIAL FOR MEDICAL COMPRESSES

The present invention relates to a non-woven material whose curly or wavy structure enables it to be used in particular as a medical or surgical compress.

At present, medical compresses are obtained from a light fabric—called dressing gauze—(weight between 25 and 28 g/m$^2$) whose manufacture requires the utilization of a costly and inefficient material. This fabric is then folded and cut into several sizes; each compress is then in general wrapped individually and sterilized.

Compresses made of conventional gauze are very flat products, adhering to wounds and having quite a low fluid absorption coefficient. In addition, their elasticity and resilience characteristics are very clearly insufficient.

The aim of much research work has been to replace the gauze by non-woven materials obtained by a dry process, wet process or so-called "spun-bonded" method and compounds of mixtures of synthetic and/or natural fibers. Although the properties of non-woven compresses are appreciably superior to those made from gauze, particularly as regards non-adhesion to wounds, they nevertheless are still far from meeting requirements as regards absorption.

The present invention relates to a non-woven material mitigating the disadvantages of non-woven materials and conventional gauze. Its particular structure enables properties such as high absorption capacity, non-adherence to wounds, elasticity, and resilience to be combined.

In general, this non-woven material has a succession of uniformly distributed waves whose anti-nodes are alternatively located above and below the medium plane of the non-woven material.

In particular, the continuous anti-nodes of two adjacent waves, located on the same side of the medium plane of the non-woven material, consist of small adjacent pads.

According to one embodiment of the invention, the non-woven material is a composite consisting of synthetic netting on which a web of cellulose fibers is fixed, in particular by thermo-bonding.

The invention will be better understood with the aid of the drawings, which represent non-limitative examples of the design of the non-woven material:

FIG. 1 is a view from below the non-woven material (1) which has a machining direction (2), corresponding to the longitudinal direction of the manufacture of said non-woven material, and a crosswise direction (3) perpendicular to the machining direction (2). This non-woven material (1) comprises evenly spaced waves or curls positioned along the lines (5) parallel to the machining direction (2).

Figure 1:
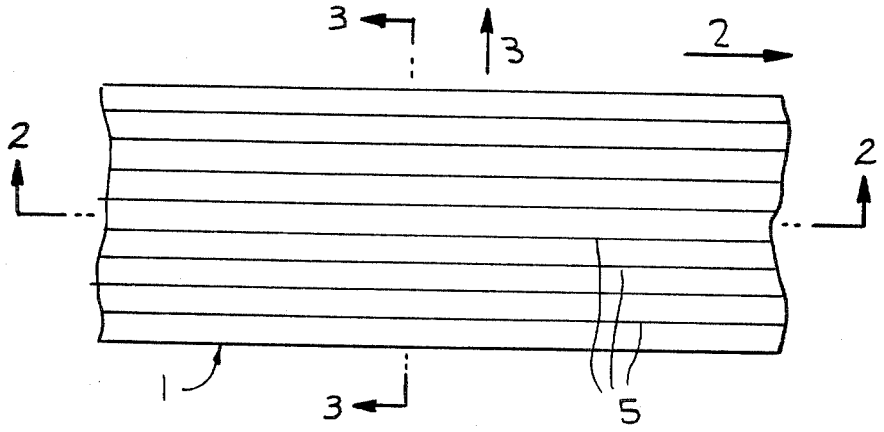
FIG. 1 is a view of the non-woven material from below.
Figure 2:
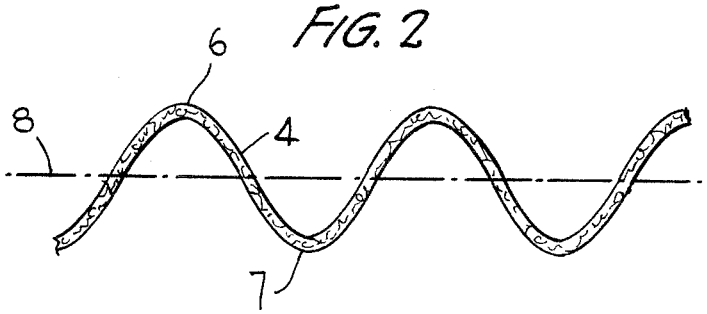
FIG. 2 is a sectional view of FIG. 1 in a plane parallel to the machining direction of the non-woven material.

FIG. 2, which is a sectional view of FIG. 1 along 2—2, in a plane parallel to the machining direction (2) shows that the non-woven material has waves (4) whose anti-nodes (6,7) are alternatively above and below the median plane (8).

Figure 3:
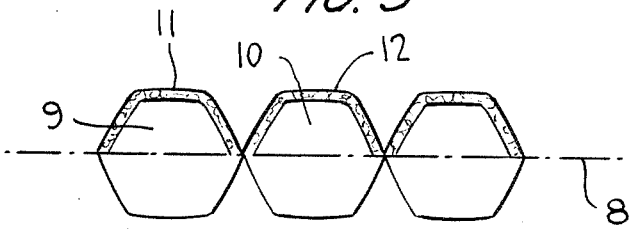
FIG. 3 is a sectional view of FIG. 1 in a plane perpendicular to the machining direction of the non-woven material.

FIG. 3 which is a sectional view of FIG. 1 along 3—3, in a plane perpendicular to the machining direction (2) shows that the contiguous anti-nodes (9,10) of adjacent waves consist of small adjacent pads (11,12) located on the same side of the median plane (8) of the non-woven material. Beyond the sectional plane is seen an outline of the pads located below the median plane (8). The height and width of these pads are between 0.1 and 3 mm.

Figure 4:
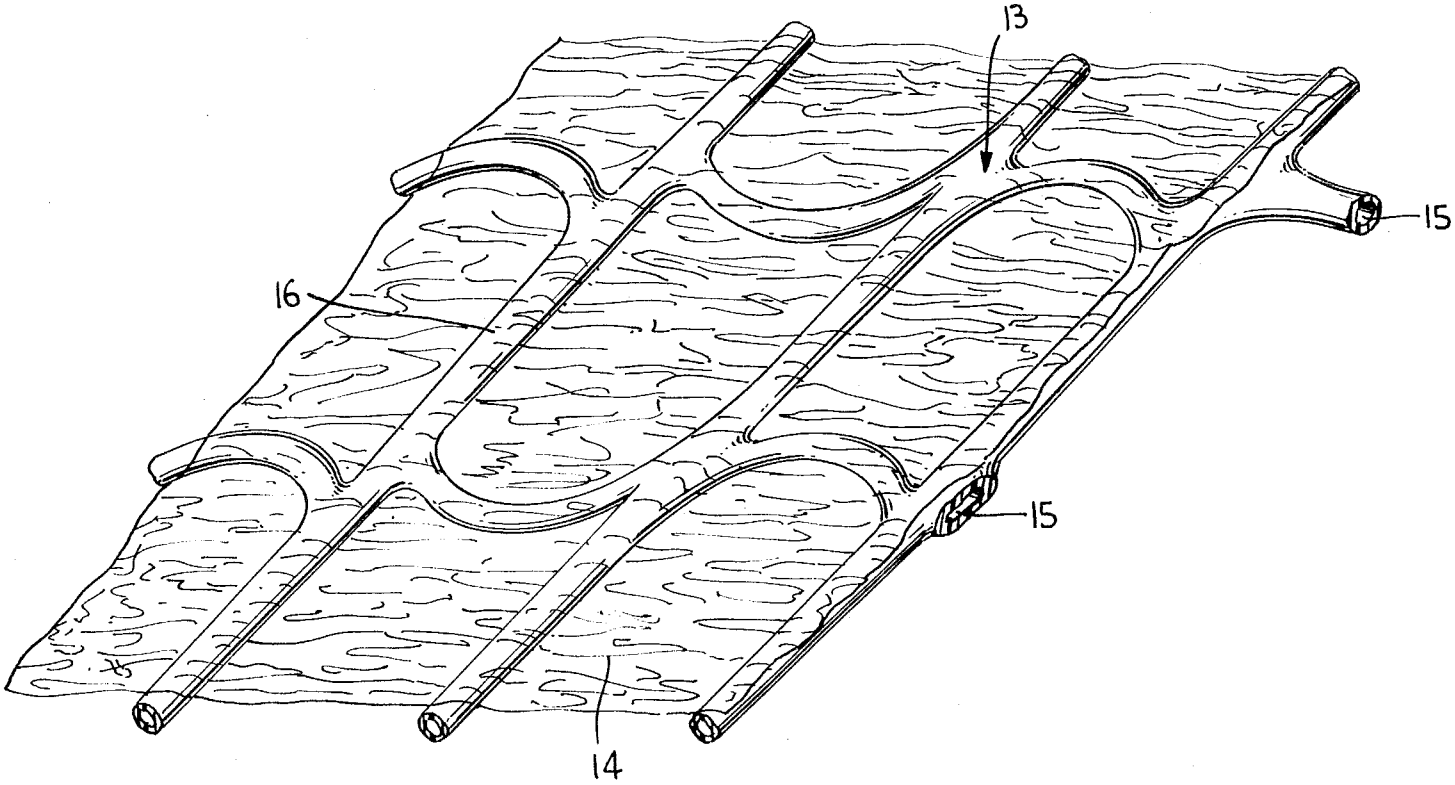
FIG. 4 is a perspective view of a non-woven material of a synthetic netting and a cellulose fiber web.

FIG. 4 shows a preferred embodiment of the invention; the non-woven material consists of a synthetic netting (13) consisting of filaments (15) of a first polymer inside a sheath of a second polymer and connected by fine lamellas (16) of a second polymer, forming a netting on the surface of which is deposited a cellulose fiber web (14).

The web (14) is thermo-bonded to the netting (13); the non-woven material, therefore, does not include any chemical binder and can, therefore, be used both as a medical and a surgical compress.

According to a preferred embodiment of the invention, the synthetic netting (13) is a double-stretched netting comprising in the machining direction (2) parallel polyamide filaments (15) separated by a uniform distance between 0.1 and 3 mm and connected to one another by narrow strips of polypropylene (16), separated regularly by a distance between 0.1 and 3 mm and perpendicular to the filaments (15). The web (14) of the cellulose fibers consists of a cotton fiber web.

In addition, this non-woven material has the advantage of being lighter in weight than conventional gauze. The netting (13) has a weight of between 5 and 15 g/m$^2$, preferably 7 g/m$^2$ and the cellulose fiber web (14) a weight between 10 and 20 g/m$^2$, preferably 16 g/m$^2$. Its bulk density is less than 0.15—preferably 0.1, and its absorption capacity is greater than 13 cm$^3$/g—preferably 16 cm$^3$/g.

The table below gives the results of measurements made on non-woven material according to the invention, on conventional gauze, and on a commerical non-woven material called PELY-TEX:

| | Non-Woven Material According To The Invention | Gauze | PELY-TEX 23VI |
|---|---|---|---|
| Weight g/m$^2$ | 24 | 25 | 23.7 |
| Thickness mm (1) | 2.40 | 1.50 | 1.40 |
| Density | 0.1 | 0.17 | 0.17 |
| Absorption Rate sec. (2) | 8 | 60 | 45 |
| Absorption Coefficient cm$^3$/g (3) | 16 | 12 | 12.7 |

(1) The thickness is defined as the thickness of 10 superimposed sheets measured under a pressure of 20 g/cm$^3$.
(2) The absorption rate is defined as the time taken by a drop of water of 1/20 cm$^3$ deposited on the surface of said non-woven material with a pipette to penetrate the non-woven material.
(3) The absorption coefficient is determined according to the CODEX standard applicable to cotton wool.

The very special structure of the non-woven material according to the invention enables compresses to be manufactured which are:

- very absorbent because of the pads described above and the presence of the cellulose fiber web;
- non-adherent to wounds because of a mode of folding such that the parts designed to come into contact with the wound consists of the bare synthetic netting;

elastic because of the presence of uniformly distributed waves;

resilient because of the framework consisting of the synthetic netting.

We claim:

1. Non-woven material for a medical or surgical compress having a machining direction and a crosswise direction, characterized in that it has a succession of waves uniformly distributed along the lines parallel to the machining direction and whose adjacent anti-nodes are alternatively located above and below the median plane of said non-woven material and in that it comprises a synthetic netting having a cellulose fiber web thermobonded to one of its faces.

2. Non-woven material according to claim 1, characterized in that the contiguous anti-nodes of two adjacent waves, located on the same side of the median plane, consist of small adjacent pads.

3. Non-woven material according to claim 2, characterized in that the height of each pad above the median plane is between 0.1 and 3 mm.

4. Non-woven material according to claim 3, characterized in that the width of each pad is between 0.1 and 3 mm.

5. Non-woven material according to claim 1, characterized in that the synthetic netting is a double-stretch netting comprising in the machining direction parallel polyamide filaments separated evenly by a distance between 0.1 and 3 mm, connected to one another by narrow strips of polypropylene separated regularly by a distance between 0.1 and 3 mm perpendicular to the filaments.

6. Non-woven material according to claim 1, characterized in that the cellulose fiber web is a cotton fiber web.

7. Non-woven material according to claim 5, characterized in that the weight of the synthetic netting is between 5 and 15 $g/m^2$ and that the cellulose fiber web between 10 and 20 $g/m^2$.

8. Non-woven material according to claim 7, characterized in that the weight of the synthetic netting is about 7 $g/m^2$ and that of the cotton fiber web is about 16 $g/m^2$.

9. Non-woven material according to claim 8, characterized in that its bulk density is less than 0.15 and its water absorption coefficient greater than 13 $cm^3/g$.

10. Non-woven material according to claim 9, characterized in that its bulk density is about 0.1 and its absorption coefficient is about 16 $cm^3/g$.

11. Non-woven material according to claim 10, characterized in that its thickness is about 0.24 mm.

12. A medical compress manufactured from non-woven material according to claim 1, characterized in that the material is folded in a way such that the part designed to come into contact with the wound is constituted of a bare synthetic netting.

* * * * *